US007513190B2

(12) United States Patent
Boehland et al.

(10) Patent No.: US 7,513,190 B2
(45) Date of Patent: Apr. 7, 2009

(54) HIGH-PRESSURE PUMP FOR A FUEL INJECTION SYSTEM OF AN INTERNAL COMBUSTION ENGINE

(75) Inventors: Peter Boehland, Marbach (DE); Godehard Nentwig, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 238 days.

(21) Appl. No.: 11/579,258

(22) PCT Filed: Mar. 1, 2005

(86) PCT No.: PCT/EP2005/050864

§ 371 (c)(1),
(2), (4) Date: Nov. 1, 2006

(87) PCT Pub. No.: WO2005/111405

PCT Pub. Date: Nov. 24, 2005

(65) Prior Publication Data

US 2008/0031744 A1 Feb. 7, 2008

(30) Foreign Application Priority Data

May 13, 2004 (DE) ..... 10 2004 023 541

(51) Int. Cl.
*F02M 59/06* (2006.01)
*F04B 1/04* (2006.01)

(52) U.S. Cl. ..... 92/158; 417/273

(58) Field of Classification Search ..... 91/488, 91/491; 92/72, 158, 160; 417/271, 273
See application file for complete search history.

(56) References Cited

U.S. PATENT DOCUMENTS

| | | | | | |
|---|---|---|---|---|---|
| 3,628,425 | A | * | 12/1971 | Morita et al. | 92/72 |
| 3,744,380 | A | * | 7/1973 | Steiger | 417/273 |
| 3,874,271 | A | * | 4/1975 | Eickmann | 91/491 |
| 6,077,056 | A | * | 6/2000 | Gmelin | 92/158 |
| 6,250,893 | B1 | * | 6/2001 | Streicher | 417/273 |
| 6,347,574 | B1 | * | 2/2002 | Guentert et al. | 92/72 |
| 6,764,285 | B1 | * | 7/2004 | Kellner | 92/72 |

FOREIGN PATENT DOCUMENTS

| | | |
|---|---|---|
| DE | 101 15 168 C1 | 8/2002 |
| DE | 101 15 167 C1 | 12/2002 |
| EP | 0 560 126 A1 | 9/1993 |

* cited by examiner

*Primary Examiner*—Thomas E Lazo
(74) *Attorney, Agent, or Firm*—Ronald E. Greigg

(57) ABSTRACT

A high-pressure pump having a rotationally driven drive shaft and at least one pump element which has a pump piston driven at least indirectly in a reciprocating motion by the drive shaft which piston is guided in a cylinder bore and with its end remote from the drive shaft defines a pump work chamber. The pump piston is braced at least indirectly on the drive shaft. Extending through the pump piston is at least one line which discharges at the circumference of the pump piston in the cylinder bore spaced apart from the end of the pump piston that defines the pump work chamber and which leads toward the drive shaft to the region where the pump piston is braced.

21 Claims, 7 Drawing Sheets

HIGH-PRESSURE PUMP FOR A FUEL INJECTION SYSTEM OF AN INTERNAL COMBUSTION ENGINE

CROSS-REFERENCE TO RELATED APPLICATIONS

This application is a 35 USC 371 application of PCT/EP2005/050864 filed on Mar. 1, 2005.

BACKGROUND OF THE INVENTION

1. Field of the Invention

The invention is directed to an improved high-pressure pump for a fuel injection system of an internal combustion engine.

2. Description of the Prior Art

One high-pressure pump known from German Patent Disclosure DE 198 44 326 A1 has a rotationally driven drive shaft and at least one pump element, with a pump piston driven at least indirectly in a reciprocating motion by the drive shaft. The pump piston is guided in a cylinder bore and, with its end remote from the drive shaft, defines a pump work chamber. The pump piston is braced at least indirectly on the drive shaft. The drive shaft has a portion which is eccentric to its pivot axis, supported on which is a ring on which the pump piston is braced directly with its piston base or via a tappet. The ring does not rotate with the drive shaft, but in operation of the high-pressure pump, a sliding motion occurs between the piston base or tappet and the ring. Lubrication of the contact region between the piston base or tappet and the ring is effected only by the fuel present in the interior of the high-pressure pump, so that under some circumstances severe wear to the pump piston and/or the tappet and/or the ring occurs, which can finally lead to failure of the high-pressure pump. The tappet may be guided displaceably in a bore in the housing of the high-pressure pump, in order to be braced against transverse forces so that they do not act on the pump piston. Lubrication between the tappet and the bore is likewise accomplished only by the fuel located in the interior of the high-pressure pump, and hence major wear to the tappet and/or the housing can also occur.

From German Patent Disclosure DE 199 07 311 A, a high-pressure pump for a fuel injection system is also known in which the drive shaft has at least one cam, on which the pump piston is braced via a tappet and a roller rotatably supported in the tappet. The bearing of the roller is again lubricated only by the fuel present in the interior of the high-pressure pump, so that wear can occur here as well.

SUMMARY AND ADVANTAGES OF THE INVENTION

The high-pressure pump of the invention has the advantage over the prior art that the lubrication in a region where the pump piston is braced with respect to the drive shaft is improved, and as a result wear is reduced. Via at least one line through the pump piston, as a consequence of leakage that necessarily occurs because of the play between the pump piston and the cylinder bore, fuel at elevated pressure that passes through in the supply stroke of the pump piston leads to lubrication of the region where the pump piston is braced.

Advantageous features and refinements of the high-pressure pump of the invention are disclosed. One embodiment enables lubrication of the area where the piston base is braced relative to the drive shaft while another enables lubrication of where the support element is braced relative to the drive shaft.

A change in the angular position between the pump piston and the support element enables the support element to be oriented in its angular position with the drive shaft independently of the pump piston. The disposition of a large-area fuel cushion between the piston base or support element and the ring enables further improvement in the lubrication. Lubrication of the bearing of the roller is made possible. One feature makes it possible to improve lubrication where the piston base or support element is guided and simple manufacture of the at least one is line possible.

Drawing BRIEF DESCRIPTION OF THE DRAWINGS

Other features and advantages of the invention will become apparent from the description contained herein below, taken in conjunction with the drawings, in which.

DESCRIPTION OF THE PREFERRED EMBODIMENTS

Figure 1:
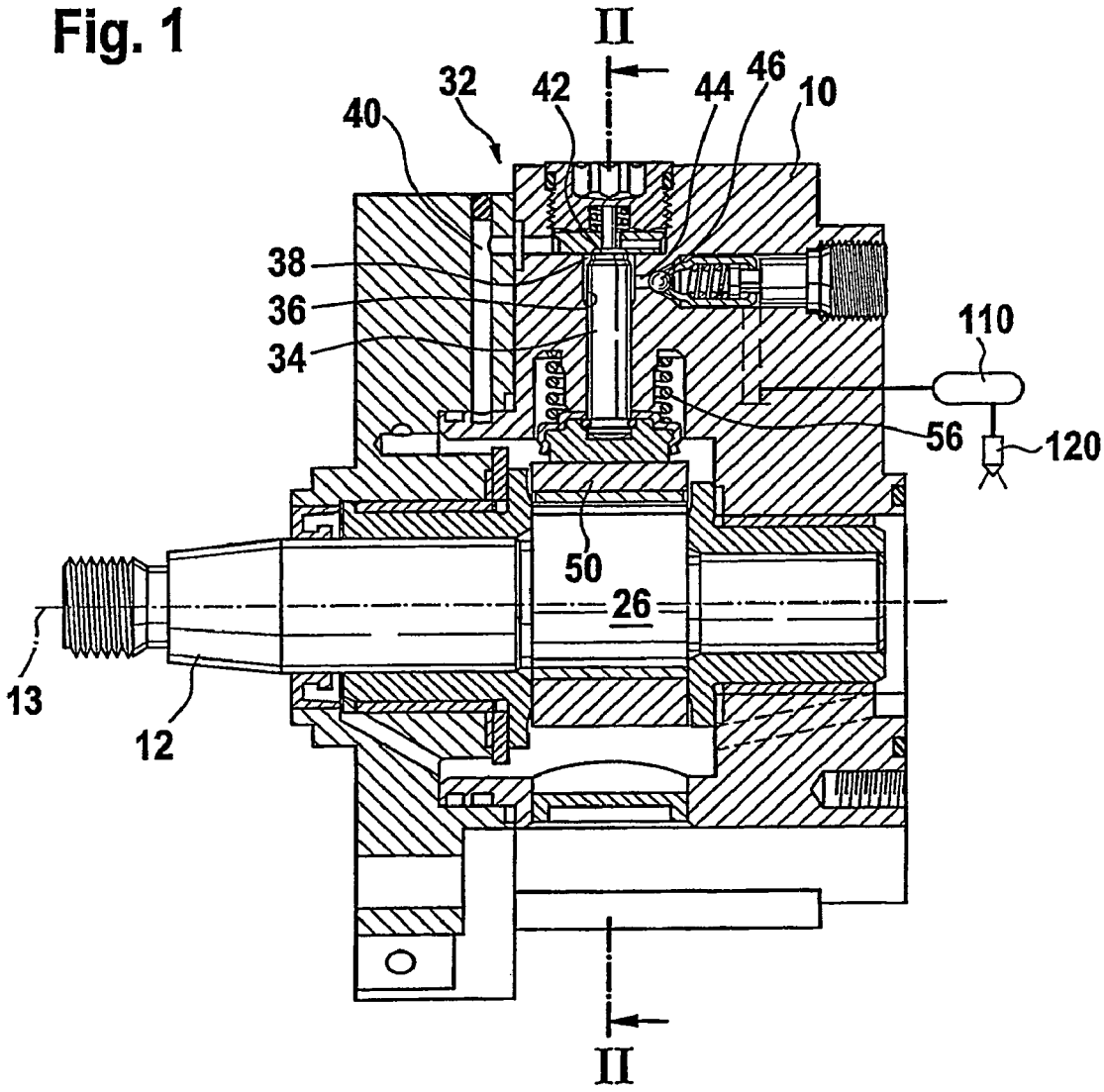
FIG. 1 shows a high-pressure pump for a fuel injection system of an internal combustion engine in a longitudinal section.
Figure 2:
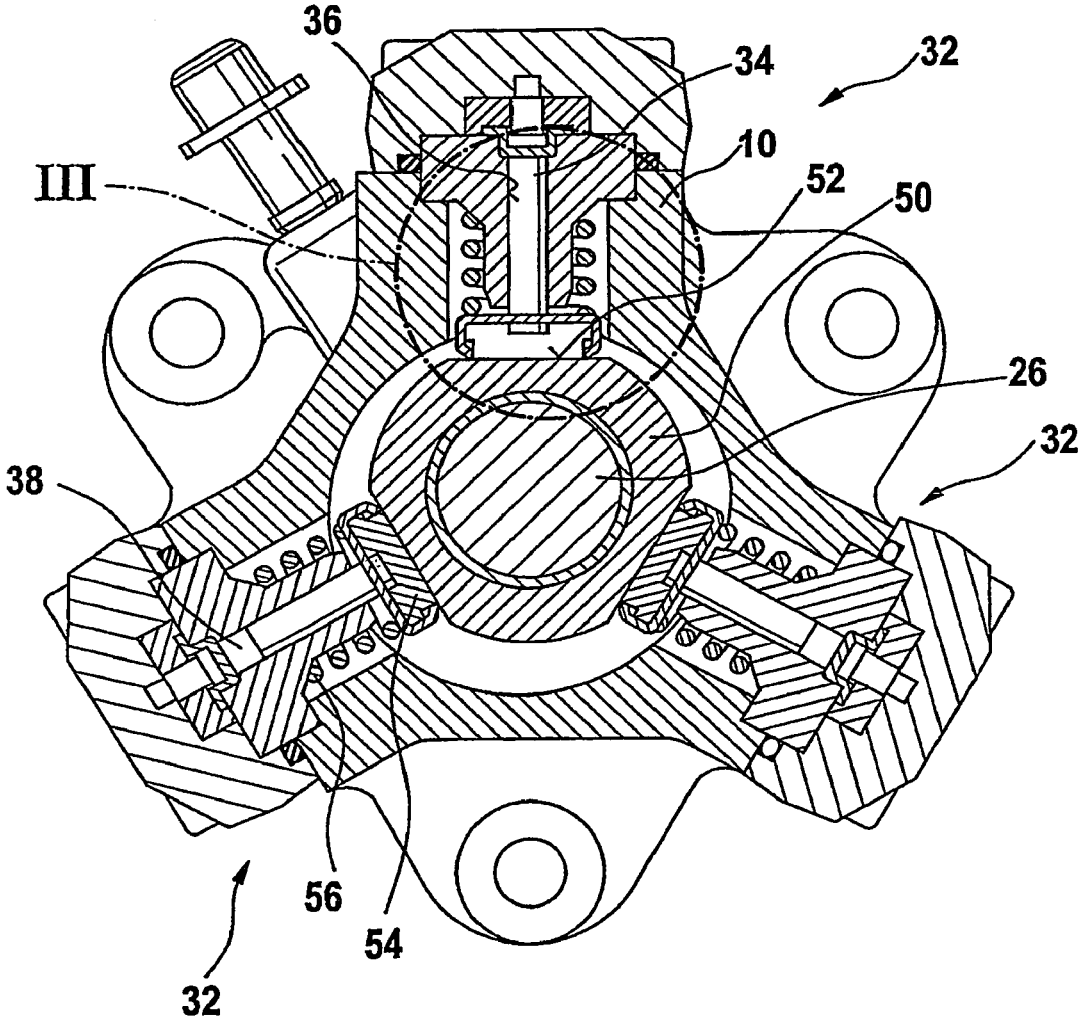
FIG. 2 shows the high-pressure pump in a cross section taken along the line II-II in FIG. 1.

In FIGS. 1-11, a high-pressure pump is shown for a fuel injection system of an internal combustion engine. The high-pressure pump has a housing 10, which may be embodied in multiple parts and in which a rotationally drivable drive shaft 12 is disposed. The drive shaft 12 is rotatably supported in the housing 10 via two bearing points, spaced apart from one another in the direction of the pivot axis 13 of the drive shaft 12. The bearing points may be disposed in different parts of the housing 10.

In a region located between the two bearing points, the drive shaft 12 has at least one cam or portion 26 that is eccentric to its pivot axis 13; the cam 26 may also be embodied as a multiple cam. The high-pressure pump has at least one or more pump elements 32, located in the housing 10, each with a respective pump piston 34 that is driven by the cam or eccentric portion 26 of the drive shaft 12 in a reciprocating motion in an at least approximately radial direction to the pivot axis 13 of the drive shaft 12. The pump piston 34 is guided tightly displaceably in a cylinder bore 36 in the housing 10, or in an insert in the housing 10, and with its face end remote from the drive shaft 12, it defines a pump work chamber 38 in the cylinder bore 36. The pump work chamber 38 has a communication with a fuel inlet, such as a feed pump, via a fuel inlet conduit 40 extending in the housing 10. An inlet valve 42 that opens into the pump work chamber is located where the fuel inlet conduit 40 discharges into the pump work chamber 38. Via a fuel outlet conduit 44 extending in the housing 10, the pump work chamber 38 furthermore has a communication with an outlet, which communicates for instance with a high-pressure reservoir 110. One or preferably more injectors 120 located at the cylinders of the engine communicate with the high-pressure reservoir 110, and through them fuel is injected into the cylinders of the engine. Where the fuel outlet conduit 44 discharges into the pump work chamber 38, there is an outlet valve 46 that opens out from the pump work chamber 38.

Figure 3:
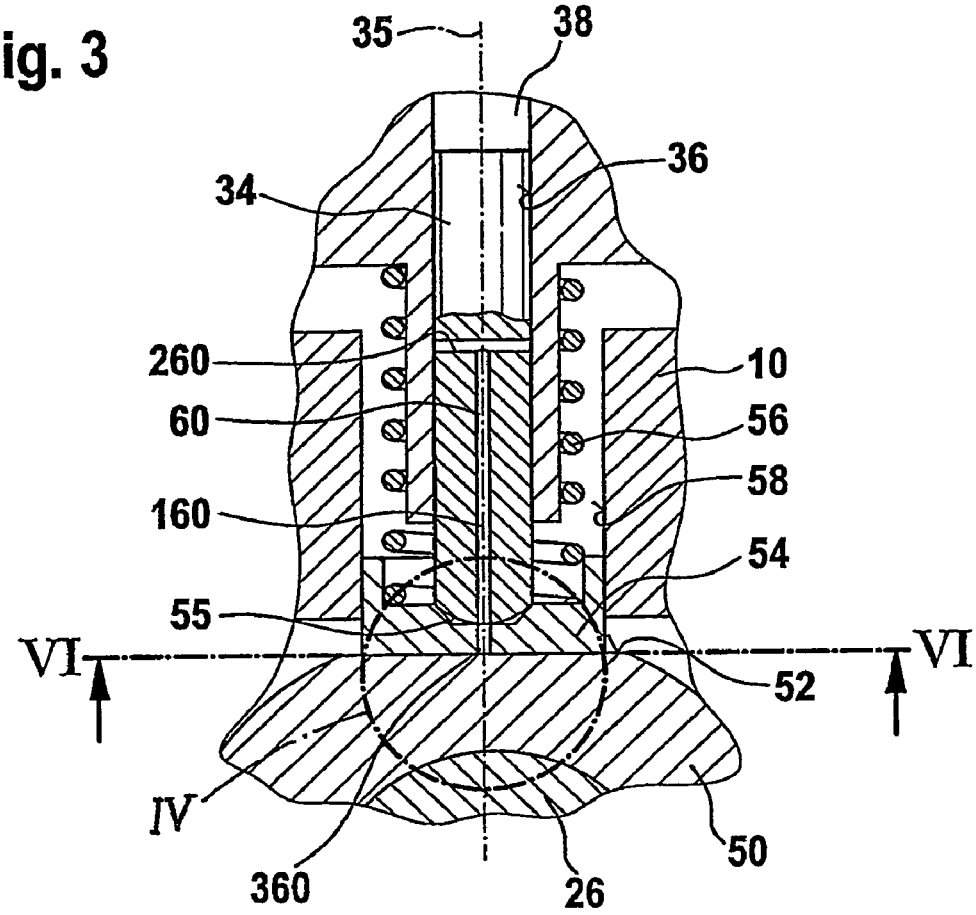
FIG. 3 shows a detail, marked III in FIG. 2, of the high-pressure pump in an enlarged view in accordance with a first exemplary embodiment.

In FIG. 3, a detail III of the high-pressure pump is shown in a first exemplary embodiment. The drive shaft 12 has the eccentric portion 26, on which a ring 50 is rotatably supported. In its circumference, the ring 50 has one flattened face 52 for each pump element 32, and the flat face has an at least essentially flat surface. The pump piston 34 of each pump element is braced on the flattened face 52 of the ring via a support element 54 in the form of a tappet. The support element 54 is connected to the pump piston 34 at least in the direction of the longitudinal axis 35 of the pump piston 34. A prestressed contact-pressure spring 56 is fastened between the housing 10 and the support element 54 and keeps support element 54 in contact with the flattened face 52 of the ring 50, even if the pump piston 34 and the support element 54 are moving inward toward the drive shaft 12 in the intake stroke of the pump piston 34. The support element 54 may be guided displaceably in a receptacle in the form of a bore 58 in the housing 10. The support element 54 has an at least substantially flat face end, with which it rests on the flattened face 52 of the ring 50.

At least one line 60 extends through the pump piston 34. On one end, line 60 discharges at the circumference of the pump piston 34 inside the cylinder bore 36, at a location spaced apart from the face end of the pump piston 34 that defines the pump work chamber 38, and on its other end, it discharges at the face end, toward the support element 54, of the pump piston 34. The line 60 is formed for instance by a longitudinal bore 160 and a transverse bore 260 through the pump piston 34. The line 60 continues through the support element 54 in the form of a bore 360, which is in communication with the longitudinal bore 160 in the pump piston 34 and which discharges on the side of the support element 54 facing toward the flattened face 52 of the ring 50. Since the pump piston 34 must be displaceable in the cylinder bore 36, there is a small annular gap between it and the cylinder bore 36. In the pumping stroke of the pump piston 34, in which the pump piston is moved outward by the eccentric portion 26 of the drive shaft 12, fuel at high pressure is compressed in the pump work chamber 38. Because of the annular gap between the pump piston 34 and the cylinder bore 36, a small leakage amount of fuel flows out of the pump work chamber 38 into the transverse bore 260 of the pump piston 34 and from there into the longitudinal bore 160 and emerges from that into the bore 360 in the support element 54 and escapes from that bore. Thus the region where the pump piston 34 is braced on the drive shaft 12, this bracing being formed by the support element 54 and the ring 50, is supplied with fuel at elevated pressure, as a result of which the lubrication is substantially improved and hence wear is reduced. By means of the disposition of the transverse bore 260 and the dimensioning of the line 60 overall, the delivered fuel quantity and the pressure of the delivered fuel can be varied. The closer the transverse bore 260 is disposed to the face end of the pump piston 34 that defines the pump work chamber 38, the greater the quantity of fuel delivered for lubrication purposes and therefore the higher the pressure of the delivered fuel. Between the support element 54 and the ring 50, given a high enough pressure and a large enough fuel quantity, hydrodynamic lubrication can be achieved, so that no wear occurs.

The connection between the pump piston 34 and the support element 54 is embodied such that changes in the angular position between the pump piston 34 and the support element 54 are possible. For instance, the end of the pump piston 34 toward the support element 54 may be convex, for instance curved at least approximately in spherical fashion. An indentation 55 may be embodied in the support element 54, into which indentation the end of the pump piston 34 is inserted, and the indentation 55 can narrow toward the ring 50, for instance at least approximately frustoconically. This embodiment of the pump piston 34 and of the support element 54 creates an articulated, or in other words pivotable, connection that makes changes in the angular position possible, so that the support element 54 can always rest flatly on the flattened face 52 of the ring 50.

Figure 4:
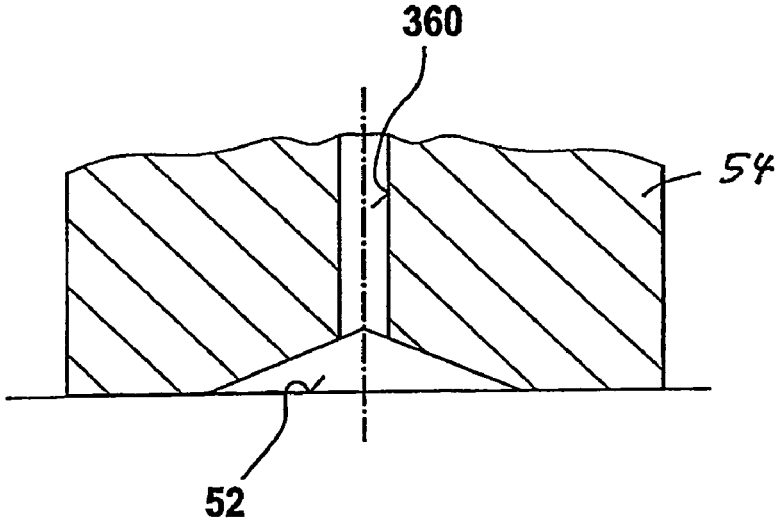
FIGS. 4-7 show the detail III in versions modified compared to FIG. 3.
Figure 5:
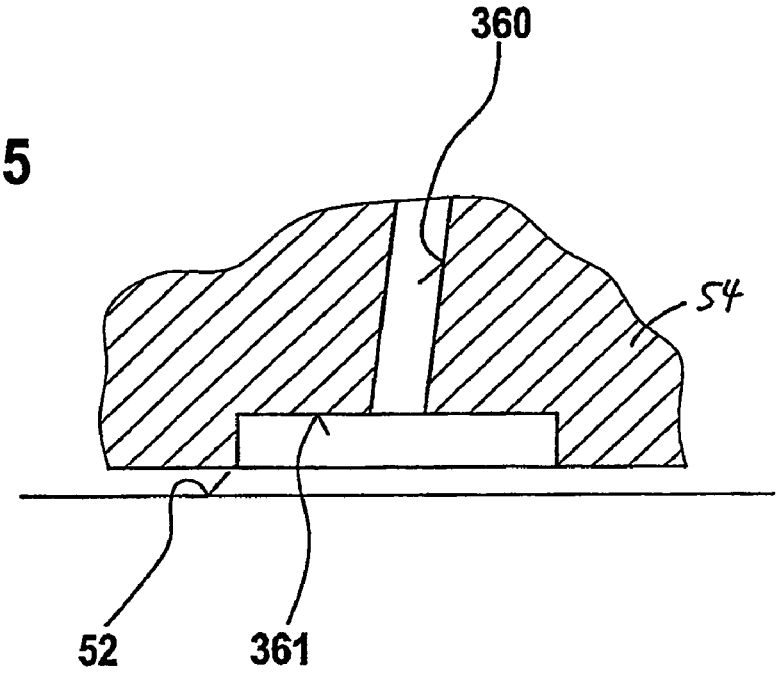

In FIG. 4, the high-pressure pump is shown in a version that is modified compared to FIG. 3; in this version, the bore 360 in the support element 54 is widened on its side toward the flattened face 52 of the ring 50, for instance being at least approximately conically widened. As a result of this embodiment of the bore 360, a fuel cushion of large area is located between the flattened face 52 of the ring 50 and the support element 54, and good lubrication is thus achieved. Alternatively, the bore 360 may also, as shown in FIG. 5, have one portion of large diameter toward the flattened face 52 of the ring 50 and one portion of small diameter toward the pump piston 34, with a step 361 being present between the portions of the bore. In this embodiment as well, a fuel cushion of large area is located between the support element 54 and the flattened face 52 of the ring and thus good lubrication is achieved.

Figure 6:
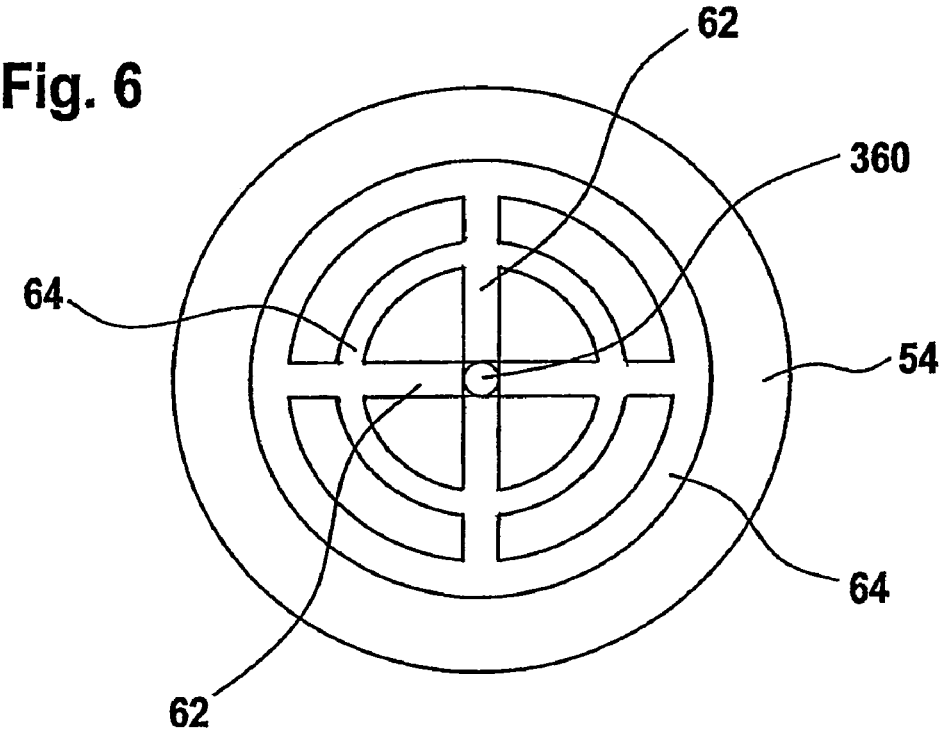

In FIG. 6, a further variant of the support element 54 is shown, in which at least one groove 62 communicating with the bore 360 is made in the face end of the support element 54 that is oriented toward the flattened face 52 of the ring 50. Preferably at least two grooves 62 are provided, each extending approximately radially to the longitudinal axis 35 of the pump piston 34 and preferably rotated by 90° from one another. It can also be provided that the at least one radial groove 62 discharges into an annular groove 64. The annular groove is preferably disposed at least approximately concentrically with the bore 360. As shown in FIG. 6, a plurality of annular grooves 64 may also be provided, which are disposed at different diameters at least approximately concentrically around the bore 360.

Figure 7:
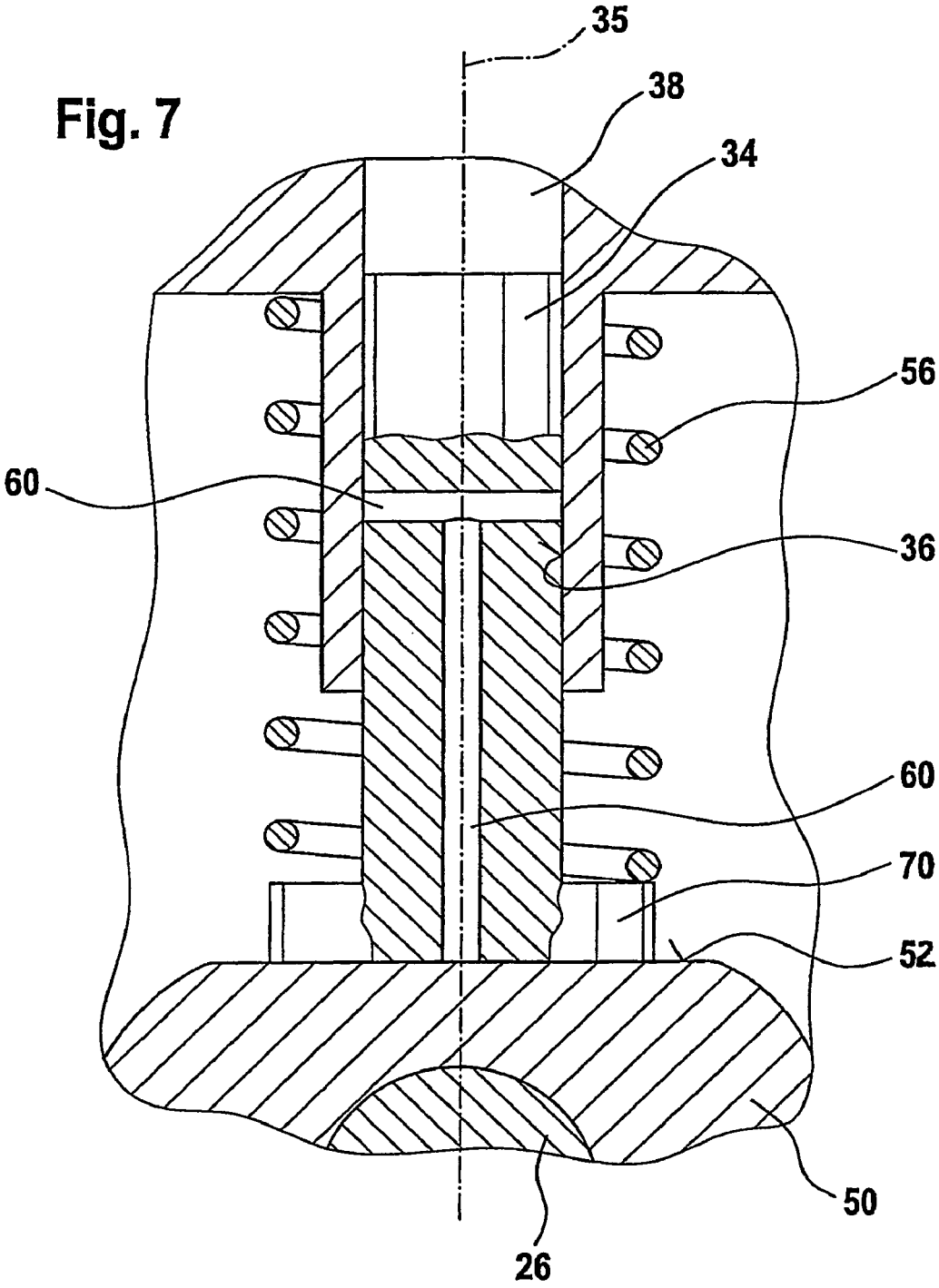

In FIG. 7, the high-pressure pump is shown in a further version modified compared to FIG. 3, in which the separate support element is omitted, and instead the pump piston 34 has a piston base 70 of enlarged diameter, compared to its region guided in the cylinder bore 36, and this base rests on the flattened face 52 of the ring 50. The side of the piston base 70 oriented toward the flattened face 52 is embodied as at least approximately flat. The longitudinal bore 160 through the pump piston 34 discharges on the side of the piston base 70 oriented toward the flattened face 52. The contact-pressure spring 56 is fastened between the housing 10 and the piston base 70. The function of the version shown in FIG. 7 is the same as in the version of FIG. 3, in that via the line 60 extending through the pump piston 34, fuel from the pump work chamber 38 is carried for lubrication into the region where the piston base 70 is braced on the flattened face 52 of the ring 50. The embodiments of FIGS. 4-6 may also be provided analogously in the version of FIG. 7.

Figure 8:
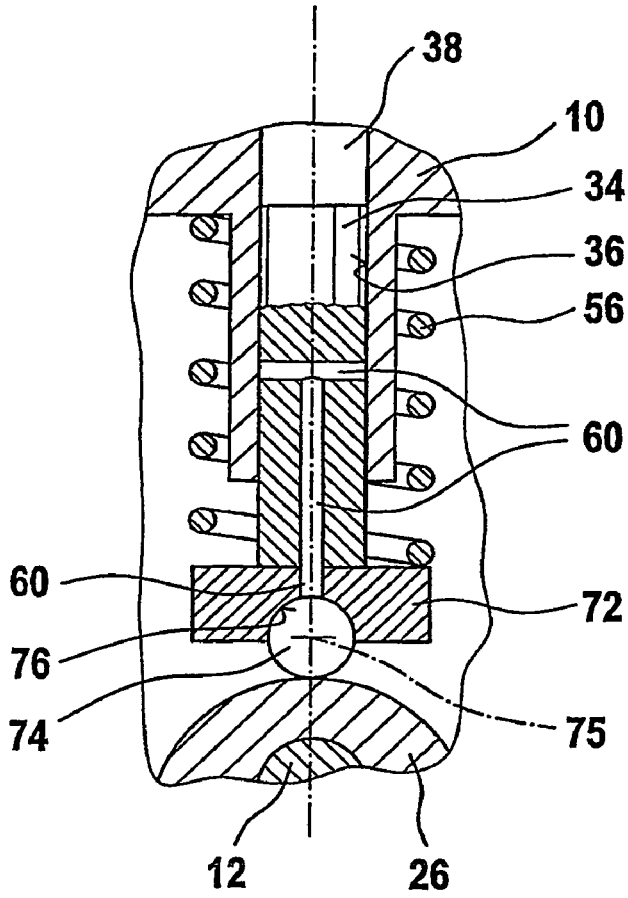
FIG. 8 shows the detail III in a second exemplary embodiment.

In FIG. 8, the high-pressure pump is shown in a second exemplary embodiment, in which the drive shaft 12 has at least one cam 26. The pump piston 34 is braced on the cam 26 of the drive shaft 12 via a support element 72 and a roller 74 that is rotatably supported in the support element 72. The pump piston 34 is connected to the support element 72, at least in the direction of its longitudinal axis 35; no pivotable connection as in the first exemplary embodiment is necessary.

The contact-pressure spring 56 is fastened between the housing 10 and the support element 72. The support element 72 may be guided displaceably in a receptacle in the form of a bore 58 in the housing 10 as in FIG. 3. The support element 72, on its side toward the cam 26, has a concave indentation 76, in which the roller 74 is rotatably supported. The roller 74 is embodied at least approximately cylindrically, and its pivot axis 75 extends at least approximately parallel to the pivot axis 13 of the drive shaft 12. The roller 74 rolls on the cam 26, so that no sliding motion occurs between the roller 74 and the cam 26. A sliding motion does occur between the roller 74 and the support element 72. As in the first exemplary embodiment, the line 60 extends through the pump piston 34, continues in the support element 72, and discharges into the indentation 76. Thus the bearing of the roller 74 in the support element 72 is supplied via the line 60 with fuel from the pump work chamber 38 for lubrication. Between the roller 74 and the support element 72, hydrodynamic lubrication can be attained.

Figure 9:
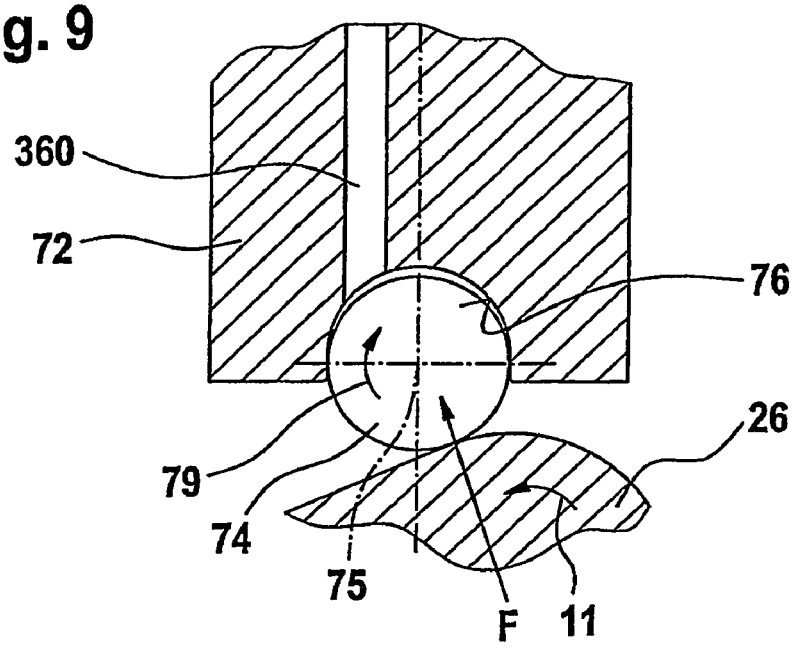
FIGS. 9-11 show the detail III in versions modified compared to FIG. 8.

The longitudinal bore 160 through the pump piston 34 and the bore 360 through the support element 72, in the version shown in FIG. 8, extend at least approximately coaxially to the longitudinal axis 35 of the pump piston 34, and the bore 360 discharges approximately centrally into the indentation 76 in which the roller 74 is supported. In FIG. 9, a version of the high-pressure pump is shown that is modified over FIG. 8; in it, the longitudinal bore 160 through the pump piston 34 and the bore 360 through the support element 72 are offset in the direction of rotation 11 of the drive shaft 12 relative to the longitudinal axis 35 of the pump piston 34. The direction of rotation of the roller 74 is represented in FIG. 9 by the arrow 79. The bore 360 thus does not discharge centrally into the indentation 76, but rather offset in the direction of rotation 11 of the drive shaft 12 with respect to the pivot axis 75 of the roller 74. In the rotary motion of the roller 74 in the direction of rotation 79, fuel emerging from the bore 360 as a result of this motion is carried along into the indentation 76, thus further improving the lubrication between the roller 74 and the support element 72.

Figure 10:
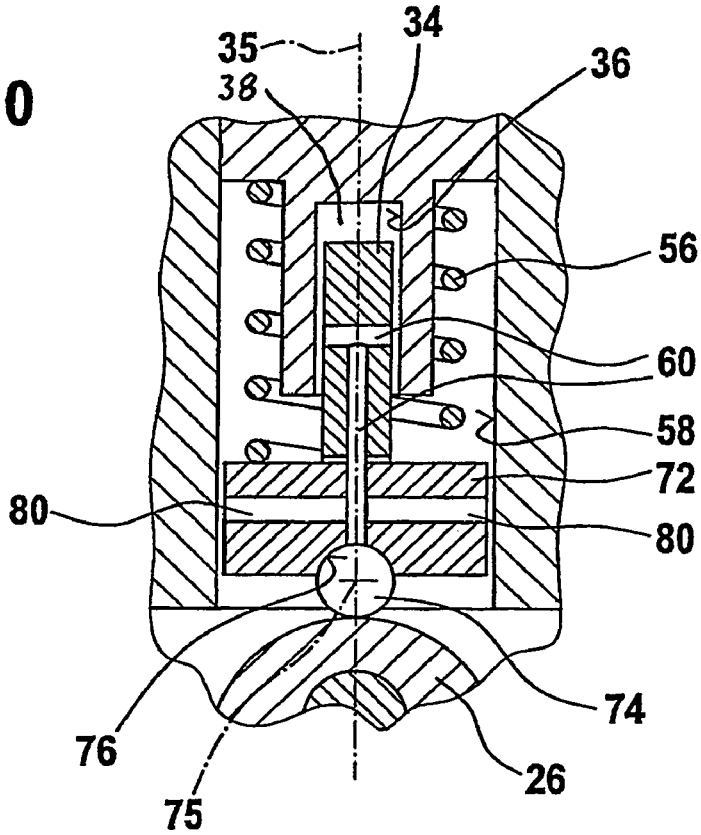

In FIG. 10, a version of the high-pressure pump is further shown that is modified, compared to the embodiment of FIG. 8, with regard to the support element 72. The support element 72 is guided displaceably in the bore 58 in the housing 10 of the high-pressure pump. In addition to the bore 360, the support element 72 has at least one branch line, in the form of a transverse bore 80, which communicates with the bore 360 and discharges at the circumference of the support element 72 in the bore 58. Preferably, as shown in FIG. 10, at least one continuous transverse bore 80 is provided in the support element 72 and extends at least approximately perpendicular to the pivot axis 13 of the drive shaft 12. By means of the at least one transverse bore 80 in the support element 72, the lubrication where the support element 72 is guided in the bore 58 is improved. The at least one transverse bore 80 may also be provided in the versions of the high-pressure pump shown in FIGS. 1 through 9, in order to improve the lubrication where the support element 54 or the piston base 70 is guided in the bore 58.

Figure 11:
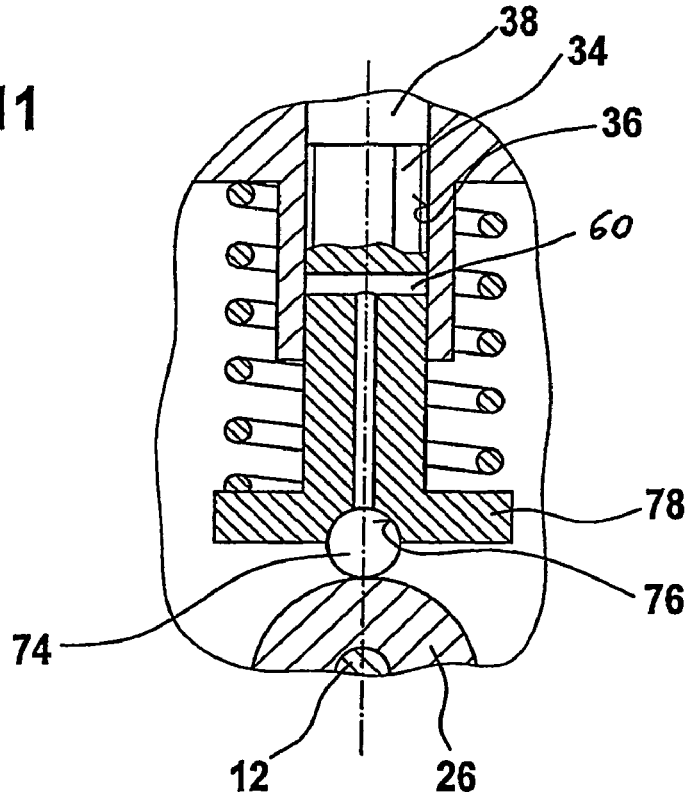

In FIG. 11, the high-pressure pump is shown in a version modified compared to the second exemplary embodiment in FIG. 8; in this version, the separate support element is omitted, and the roller 74 is rotatably supported directly in an indentation 76 in a piston base 78 of the pump piston 34, the diameter of the piston base being increased compared to that in its region that is guided in the cylinder bore 36. The line 60 through the pump piston 34 discharges into the indentation 76 and thus enables the lubrication of the bearing of the roller 74. The contact-pressure spring 56 is fastened between the housing 10 and the piston base 78. In the piston base 78, analogously to the version of FIG. 10, at least one transverse bore 80 may additionally be provided, for improving the lubrication where the piston base 78 is guided in the bore 58 of the housing 10.

Upon the rotary motion of the drive shaft 12, the pump piston 34 is driven in a reciprocating motion. In the intake stroke of the pump piston 34, in which this piston moves radially inward, the pump work chamber 38 is filled with fuel through the fuel inlet conduit 40 with the iv 42 open, the outlet valve 46 being closed. In the pumping stroke of the pump piston 34, in which this piston moves radially outward, fuel is pumped by the pump piston 34 at high pressure through the fuel outlet conduit 44, with the outlet valve 46 open, to the high-pressure reservoir 110, the inlet valve 42 being closed. In the pumping stroke of the pump piston 34, the greatest load occurs between the ring 50 and the support element 54 or the piston base 70, or between the roller 74 and the support element 72 or the piston base 78; in that case, adequate lubrication is assured by the fuel in this region that is supplied from the pump work chamber 38 via the line 60.

The foregoing relates to a preferred exemplary embodiment of the invention, it being understood that other variants and embodiments thereof are possible within the spirit and scope of the invention, the latter being defined by the appended claims.

The invention claimed is:

1. A high-pressure pump for a fuel injection system of an internal combustion engine, the pump comprising a pump housing, a rotationally driven drive shaft, at least one pump element which has a pump piston driven at least indirectly in a reciprocating motion by the drive shaft and which is guided in a cylinder bore in the pump housing and with its end remote from the drive shaft defines a pump work chamber, the pump piston being braced at least indirectly on the drive shaft, and only at least one line extending through the pump piston which discharges at the circumference of the pump piston in the cylinder bore spaced apart from the end of the pump piston that defines the pump work chamber, and which leads toward the drive shaft is provided to the region where the pump piston is braced.

2. The high-pressure pump as defined by claim 1, further comprising a piston base of enlarged cross section, compared to its region guided in the cylinder bore, the base bracing the piston at least indirectly on the drive shaft, the at least one line discharging on the side of the piston base toward the drive shaft.

3. The high-pressure pump as defined by claim 2, wherein the drive shaft comprises a portion which is eccentric to its pivot axis, and a ring rotatably supported on the eccentric portion, the pump piston being braced on the ring with its piston base or via a support element.

4. The high-pressure pump as defined by claim 3, wherein the cross section of the line, in its outlet region toward the ring, is enlarged compared to the remaining cross section of the line.

5. The high-pressure pump as defined by claim 4, wherein the ring, in the region of contact with the piston base or with the support element, has an at least substantially flat face.

6. The high-pressure pump as defined by claim 3, wherein the ring, in the region of contact with the piston base or with the support element, has an at least substantially flat face.

7. The high-pressure pump as defined by claim 1, further comprising a support element bracing the pump piston at least indirectly on the drive shaft, the at least one line continuing in the support element and discharging on the side of the support element toward the drive shaft.

8. The high-pressure pump as defined by claim 7, wherein the pump piston and the support element are pivotably connected to one another.

9. The high-pressure pump as defined by claim 8, wherein the drive shaft comprises a portion which is eccentric to its pivot axis, and a ring rotatably supported on the eccentric portion, the pump piston being braced on the ring with the support element.

10. The high-pressure pump as defined by claim 7, wherein the drive shaft comprises a portion which is eccentric to its pivot axis, and a ring rotatably supported on the eccentric portion, the pump piston being braced on the ring with the support element.

11. A high-pressure pump for a fuel injection system of an internal combustion engine, the pump comprising a pump housing, a rotationally driven drive shaft, at least one pump element which has a pump piston driven at least indirectly in a reciprocating motion by the drive shaft and which is guided in a cylinder bore in the pump housing and with its end remote from the drive shaft defines a pump work chamber, the pump piston being braced at least indirectly on the drive shaft, at least one line extending through the pump piston which discharges at the circumference of the pump piston in the cylinder bore spaced apart from the end of the pump piston that defines the pump work chamber, and which leads toward the drive shaft to the region where the pump piston is braced, a piston base of enlarged cross section, compared to its region guided in the cylinder bore, the base bracing the piston at least indirectly on the drive shaft, the at least one line discharging on the side of the piston base toward the drive shaft, wherein the drive shaft comprises a portion which is eccentric to its pivot axis, and a ring rotatably supported on the eccentric portion, the pump piston being braced on the ring with its piston base or via a support element, and at least one groove communicating with the line, the at least one groove being disposed in the face end, toward the ring, of the piston base or of the support element.

12. The high-pressure pump as defined by claim 11, wherein the ring, in the region of contact with the piston base or with the support element, has an at least substantially flat face.

13. A high-pressure pump for a fuel injection system of an internal combustion engine, the pump comprising a pump housing, a rotationally driven drive shaft, at least one pump element which has a pump piston driven at least indirectly in a reciprocating motion by the drive shaft and which is guided in a cylinder bore in the pump housing and with its end remote from the drive shaft defines a pump work chamber, the pump piston being braced at least indirectly on the drive shaft, and at least one line extending through the pump piston which discharges at the circumference of the pump piston in the cylinder bore spaced apart from the end of the pump piston that defines the pump work chamber, and which leads toward the drive shaft to the region where the pump piston is braced, wherein the pump piston is braced via a rotatably supported roller that rolls on a cam of the drive shaft; and wherein the at least one line discharges in the region of the bearing of the roller.

14. The high-pressure pump as defined by claim 13, wherein the roller is rotatably supported in a support element on which the pump piston is braced by its end toward the drive shaft.

15. The high-pressure pump as defined by claim 14, wherein the support element is displaceably guided in a receptacle; and wherein at least one branch line, discharging at the circumference of the support element inside the receptacle, leads away from the line.

16. The high-pressure pump as defined by claim 13, wherein the roller is rotatably supported in a piston base, toward the drive shaft, of the pump piston.

17. The high-pressure pump as defined by claim 16, characterized in that the piston base is displaceably guided in a receptacle; and wherein at least one branch line, discharging at the circumference of the piston base inside the receptacle, leads away from the line.

18. The high-pressure pump as defined by claim 13, wherein the discharge outlet of the line into the bearing of the roller is offset from the pivot axis of the roller in the direction of rotation of the drive shaft.

19. A high-pressure pump for a fuel injection system of an internal combustion engine, the pump comprising a pump housing, a rotationally driven drive shaft, at least one pump element which has a pump piston driven at least indirectly in a reciprocating motion by the drive shaft and which is guided in a cylinder bore in the pump housing and with its end remote from the drive shaft defines a pump work chamber, the pump piston being braced at least indirectly on the drive shaft, at least one line extending through the pump piston which discharges at the circumference of the pump piston in the cylinder bore spaced apart from the end of the pump piston that defines the pump work chamber, and which leads toward the drive shaft to the region where the pump piston is braced, a piston base of enlarged cross section, compared to its region guided in the cylinder bore, the base bracing the piston at least indirectly on the drive shaft, the at least one line discharging on the side of the piston base toward the drive shaft, wherein the piston base is displaceably guided in a receptacle; and wherein at least one branch line, discharging at the circumference of the piston base inside the receptacle, leads away from the line.

20. A high-pressure pump for a fuel injection system of an internal combustion engine, the pump comprising a pump housing, a rotationally driven drive shaft, at least one pump element which has a pomp piston driven at least indirectly in a reciprocating motion by the drive shaft and which is guided in a cylinder bore in the pump housing and with its end remote from the drive shaft defines a pump work chamber, the pump piston being braced at least indirectly on the drive shaft, and at least one line extending through the pump piston which discharges at the circumference of the pump piston in the cylinder bore spaced apart from the end of the pump piston that defines the pump work chamber, and which leads toward the drive shaft to the region where the pump piston is braced, a support element bracing the pump piston at least indirectly on the drive shaft, the at least one line continuing in the support element and discharging on the side of the support element toward the drive shaft, wherein the support element is displaceably guided in a receptacle; and wherein at least one branch line, discharging at the circumference of the support element inside the receptacle, leads away from the line.

21. A high-pressure pump for a fuel injection system of an internal combustion engine, the pump comprising a pump housing, a rotationally driven drive shaft, at least one pump element which has a pump piston driven at least indirectly in a reciprocating motion by the drive shaft and which is guided in a cylinder bore in the pump housing and with its end remote from the drive shaft defines a pump work chamber, the pump piston being braced at least indirectly on the drive shaft, and only at least one line extending through the pump piston which discharges at the circumference of the pump piston in the cylinder bore spaced apart from the end of the pump piston that defines the pump work chamber, and which leads toward the drive shaft is provided to the region where the pump piston is braced, wherein the at least one line includes at least one longitudinal bore and at least one transverse bore in the pump piston, the transverse bore discharging at the circumference of the pump piston.

* * * * *